US007190120B1

(12) United States Patent
Sansone et al.

(10) Patent No.: US 7,190,120 B1
(45) Date of Patent: Mar. 13, 2007

(54) AIRPORT STROBE LIGHT MONITORING SYSTEM

(75) Inventors: John M. Sansone, Oak Lawn, IL (US); Christopher D. Wozniak, Chicago, IL (US)

(73) Assignee: Multi Electric Mfg. Inc., Chicago, IL (US)

( * ) Notice: Subject to any disclaimer, the term of this patent is extended or adjusted under 35 U.S.C. 154(b) by 0 days.

(21) Appl. No.: 11/123,420

(22) Filed: May 6, 2005

(51) Int. Cl.
*H05B 37/00* (2006.01)

(52) U.S. Cl. ..... 315/120; 315/130; 315/200 A

(58) Field of Classification Search ..... 315/120, 315/200 A, 130
See application file for complete search history.

(56) References Cited

U.S. PATENT DOCUMENTS 4,241,295 A * 12/1980 Williams, Jr. ..... 315/294

4,449,073 A * 5/1984 Mongoven et al. ..... 315/130

* cited by examiner

*Primary Examiner*—David Vu
(74) *Attorney, Agent, or Firm*—Nicholas A. Camasto

(57) ABSTRACT

An airport strobe lighting system includes a BCD source of pulses generating trigger voltages for a plurality of strobe lamps and a sensor circuit for comparing confirmation signals with the trigger pulses and generating corresponding return pulses indicative of the operation of the strobe lamps. A microcontroller is supplied with conditioned 5 bit address inputs from the BCD source of pulses and conditioned confirmation signal outputs from the sensor circuit and compares each confirmation signal with the 5 bit address of the corresponding strobe lamp. The microcontroller controls the illumination of dedicated LEDs to indicate the status of each of the strobe lamps.

11 Claims, 2 Drawing Sheets

AIRPORT STROBE LIGHT MONITORING SYSTEM

BACKGROUND OF THE INVENTION AND PRIOR ART

The disclosure of U.S. Pat. No. 4,449,073, issued May 15, 1984 is hereby incorporated by reference in this application.

This invention relates to airport runway approach monitoring systems that typically employ a series of sequentially activated strobe lamps for visually assisting aircraft landings. In the above-mentioned U.S. Pat. No. 4,449,073 such a system is described. It includes an oscillator driven counter that generates clock pulses to produce trigger signals for sequentially energizing the runway strobe lamps. The strobe lamp operations generate corresponding return pulses that are compared with the oscillator pulses and a fault signal is generated whenever there is no return pulse in response to a trigger pulse. A fault indication is provided at a central location after the occurrence of a predetermined number of fault signals in a predetermined time period.

SUMMARY OF THE INVENTION

The present invention is an improvement on the arrangement disclosed in that patent. Specifically a microcomputer, which is supplied with the binary coded decimal (BCD) addresses of the individual strobe lamps, compares the return pulses that are generated in response to the activation of the strobe lamps with the addresses and indicates the status of each individual strobe lamp by means of a corresponding LED indicator. With the invention, the status of each strobe lamp may be immediately determined by observation of its corresponding LED indicator.

OBJECTS OF THE INVENTION

A principal object of the invention is to provide a novel airport strobe lighting system.

Another object of the invention is to provide an airport strobe lighting system of enhanced serviceability and maintenance.

A feature of the invention resides in the provision of a microcontroller for identifying each strobe lamp and indicating its operating condition.

BRIEF DESCRIPTION OF THE DRAWINGS

These and other objects and advantages of the invention will be apparent upon reading the following description in conjunction with the drawings in which.

DESCRIPTION OF THE PREFERRED EMBODIMENT

Figure 1:
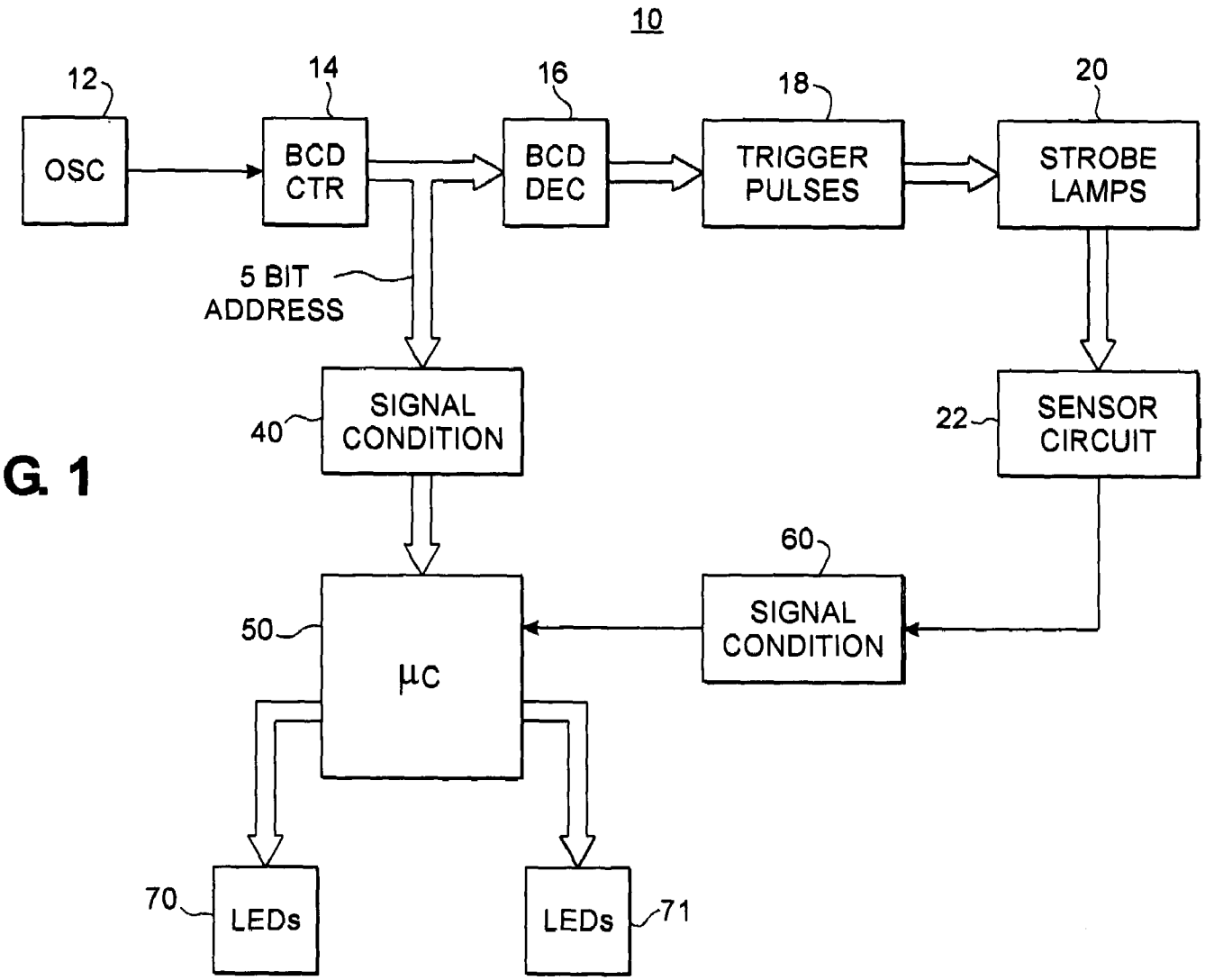
FIG. 1 is a simplified block diagram of an airport strobe light system constructed in accordance with the invention.

The block diagram of FIG. 1 adds the invention to the airport strobe light system disclosed in the above-mentioned patent. Reference should be made to that patent for a detailed description of the circuitry and apparatus for sequentially firing the plurality of individual strobe lamps in the system. In the patented system, failure of a strobe lamp to fire resulted in a fault signal being returned to a fault counter, with the detection of a predetermined number of fault signals in a predetermined time period being required to produce a failure indication. The present invention provides a microcontroller for positively identifying the status of each one of the plurality of strobe lamps by means of a corresponding plurality of dedicated light-emitting diodes (LEDs).

Referring to FIG. 1, an airport strobe light system 10 includes an oscillator 12 that generates pulses that are supplied to a BCD counter 14. BCD counter 14 supplies 5 bits of coded pulses which are received by a BCD detector 16 and supplied to a trigger pulse block 18 to form a sequential chain of pulses for firing a plurality of strobe lamps 20. A sensor circuit 22 responds to the firing of each strobe lamp to produce corresponding return pulses. The circuit as described in the same as that in the above-mentioned patent.

In accordance with the invention, a microcontroller 50 is provided and the 5 bit address 41, identifying the to-be-developed trigger pulses, is supplied to microcomputer 50 through a signal conditioner 40. As is shown in detail in FIG. 2, signal conditioner 40 converts the 12 volt DC complementary metal oxide semiconductors (CMOS) in the patented circuit to the 5 volt DC required by microcomputer 50. Another signal conditioner circuit 60 takes the output of sensor circuit 22, shapes the pulses and converts their voltage for application to microcontroller 50. Two light emitting diode (LED) arrangements 70 and 71 are controlled by microcontroller 50 to identify the status of each strobe lamp in the system as determined by a comparison of the pulse output of signal conditioner 60 with the corresponding address of the strobe lamp, as identified by the trigger pulse for that strobe lamp.

Figure 2:
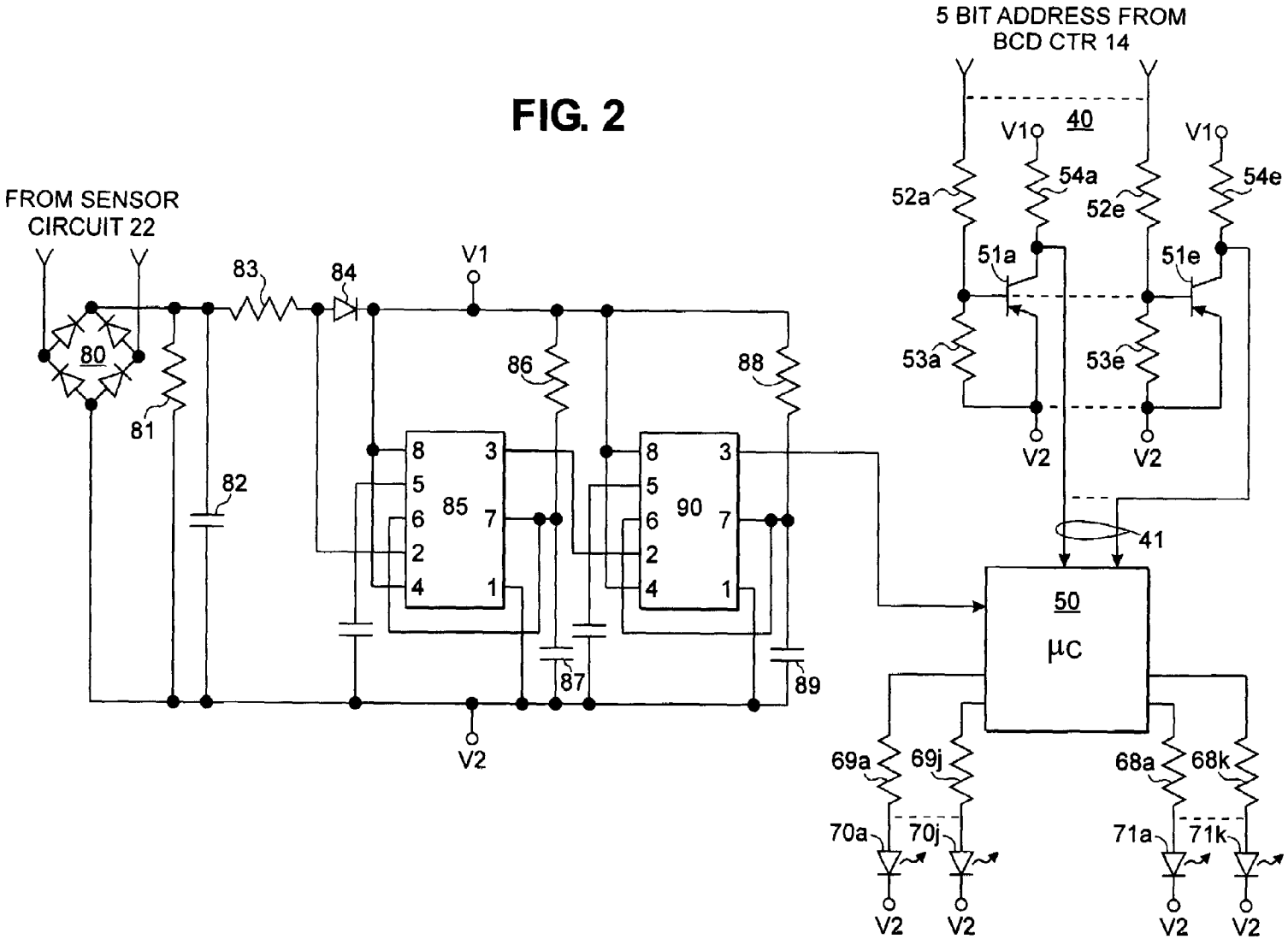
FIG. 2 is partial schematic of FIG. 1 disclosing the microcontroller arrangement of the invention.

In FIG. 2, the five bit addresses from BCD counter 14 are supplied to signal conditioner 40 which consists of five transistors 51*a*–51*e* that are arranged to convert 12 volts DC to 5 volts DC. Specifically, the address bits are supplied through resistors 52*a*–52*e* to the bases of transistors 51*a*–51*e*, which are returned to a potential V2, respectively. The collectors are supplied from a potential V1 through resistors 54*a*–54*e* and the emitters are connected to a potential V2. The conditioned address 41, which is at volts DC is coupled from the collectors to microcontroller 50.

The return signals from sensor circuit 22 are applied to the opposite corners of a diode bridge 80 for assuring that the return signals have the same polarity. The signals are filtered by a parallelly connected resistor 81 and capacitor 82 and coupled through a resistor 83 to a pair of serially connected type 555 conventional timers 85 and 90 that are connected between V1 and V2. Specifically, the filtered signals are supplied to pin 2 of timer 85. The output of timer 85 is taken from pin 3 and supplied to the input pin 2 of timer 90. The output of timer 90 is taken from pin 3 and coupled to microcontroller 50. Pins 7 of the timers are connected to V1 through resistors 86 and 88 and returned to V2 through timing capacitors 87 and 89, respectively. The conditioned signals that are supplied to the microcontroller are thus shaped, of the same polarity and are at 5 volts DC, as required by the microcontroller.

The LED arrangement consists of two banks 70*a*–70*j* and 71*a*–71*k*, often and eleven LEDs, respectively, (for a total of twenty one LEDs) that are coupled through corresponding resistors 68*a*–68*j* and 69*a*–69*k*, respectively between microcontroller 50 and V2. In operation, microcontroller 50 assigns a specific LED to a specific address and notes whether a conditioned return pulse is received as the corresponding addresses are clocked. If a return pulse is received, the corresponding LED is illuminated, whereas if a return pulse is not received, the corresponding LED is not illuminated. Hence it is a simple matter for the operator to determine the functionality of any of the strobe lamps in the system by observation of the illuminated status of its corresponding LED.

What has been described is a novel arrangement that incorporates LEDs for determining the operational status of individual ones of a plurality of strobe lamps in an airport strobe light system. It is recognized that changes in the described embodiment of the invention will be apparent to those skilled in the art without departing from the spirit thereof and that the invention is to be limited only as defined in the claims.

The invention claimed is:

1. An airport strobe light and monitoring system comprising:

a plurality of strobe lamps;

a source of BCD control pulses;

a BCD decoder arrangement generating trigger pulses from said control pulses for sequentially energizing said strobe lamps;

a sensor circuit generating confirmation signals responsive to operations of said strobe lamps;

a microcontroller;

said microcontroller being supplied with a five bit input of said BCD control pulses defining an address for each of said strobe lamps;

a plurality of indicators, corresponding to said plurality of strobe lamps, respectively, coupled to said microcontroller; and said microcontroller comparing said confirmation signals with said addresses and controlling said indicators to denote the statuses of said strobe lamps.

2. The system of claim 1, wherein said indicators comprise LEDs.

3. The system of claim 2, wherein said source of BCD control pulses and said sensor circuit operate at a first potential and said microcontroller operates at a second, lower potential, and further including:

a first signal conditioning circuit interposed between said microcontroller and said source of BCD control pulses;

a second signal conditioning circuit interposed between said microcontroller and said sensor circuit;

said first and said second signal conditioning circuits converting said second potentials to said first potential.

4. The system of claim 3, wherein said first potential is 12 volts DC and said second potential is 5 volts DC and wherein said first signal conditioning circuit comprises:

a transistor, for each bit of said five bit BCD control pulses, having its input receiving said control pulse information at 12 volts DC and supplying a 5 volts DC output to said microcontroller.

5. The system of claim 3 wherein said first potential is 12 volts DC and said second potential is 5 volts DC and wherein said second signal conditioning circuit comprises:

a diode bridge for receiving said confirmation signals at 12 volts DC and converting them to a common polarity;

a pair of serially connected timers for shaping said confirmation signals; and a connection from said timer to said microcontroller supplying conditioned signals thereto of 5 volts DC potential.

6. The system of claim 4, wherein an LED is illuminated when its corresponding strobe lamp is operating and is extinguished when its corresponding strobe lamp has failed to fire.

7. The system of claim 4, wherein an LED is illuminated when its corresponding strobe lamp is operating and is extinguished when its corresponding strobe lamp has failed to fire.

8. An airport strobe light and monitoring system comprising:

a plurality of strobe lamps;

a source of BCD control pulses;

a BCD decoder arrangement generating trigger pulses from said control pulses for sequentially energizing said strobe lamps;

a sensor circuit generating confirmation signals responsive to operations of said strobe lamps;

a microcontroller;

said microcontroller being supplied with a five bit input of said BCD control pulses defining an address for each of said strobe lamps;

a first and a second signal conditioning circuit coupled between said microcontroller and said 5 bit input of BCD control pulses and between said microcontroller and said sensor circuit, respectively;

a plurality of LED indicators, corresponding to said plurality of strobe lamps, respectively, coupled to said microcontroller; and said microcontroller comparing said confirmation signals with said addresses and illuminating said LED indicators when said corresponding strobe lamps have fired.

9. The system of claim 8, wherein said BCD decoder arrangement and said sensor circuit operate at 12 volts DC and said microcontroller operates at 5 volts DC and wherein said first and said second conditioning circuits convert 12 volts DC to 5 volts DC.

10. The system of claim 9 wherein said first signal conditioning circuit comprises:

a transistor, for each bit of said five bit BCD control pulses, having its input receiving said control pulse information at 12 volts DC and supplying a 5 volts DC output to said microcontroller.

11. The system of claim 9, wherein said second signal conditioning circuit comprises:

a diode bridge for receiving said confirmation signals at 12 volts DC and converting them to a common polarity;

a pair of serially connected timers for shaping said confirmation signals; and a connection from said timer to said microcontroller supplying conditioned signals thereto of 5 volts DC potential.

* * * * *